US008025020B2

(12) United States Patent
Yasuda et al.

(10) Patent No.: US 8,025,020 B2
(45) Date of Patent: Sep. 27, 2011

(54) AUXILIARY FLOAT OF FLOATING STRUCTURE AND METHOD FOR REMODELING FLOATING STRUCTURE

(75) Inventors: Tetsuya Yasuda, Tokyo (JP); Masanori Nemoto, Tokyo (JP); Hiromitsu Yamamoto, Tokyo (JP); Kozo Yokokura, Tokyo (JP)

(73) Assignee: IHI Marine United Inc., Tokyo (JP)

( * ) Notice: Subject to any disclaimer, the term of this patent is extended or adjusted under 35 U.S.C. 154(b) by 0 days.

(21) Appl. No.: 12/308,739

(22) PCT Filed: Jul. 5, 2007

(86) PCT No.: PCT/JP2007/063434

§ 371 (c)(1),
(2), (4) Date: Dec. 22, 2008

(87) PCT Pub. No.: WO2008/004608

PCT Pub. Date: Jan. 10, 2008

(65) Prior Publication Data

US 2009/0183666 A1 Jul. 23, 2009

(30) Foreign Application Priority Data

Jul. 7, 2006 (JP) ..... 2006-187782

(51) Int. Cl.
*B63B 35/44* (2006.01)

(52) U.S. Cl. ..... 114/264; 405/205

(58) Field of Classification Search ..... 114/264, 114/266, 267; 405/204, 205, 206, 207, 223.1, 405/224, 195.1, 200, 211
See application file for complete search history.

(56) References Cited

U.S. PATENT DOCUMENTS

| | | | | |
|---|---|---|---|---|
| 3,289,419 | A * | 12/1966 | McGowen, Jr. | 405/205 |
| 3,797,438 | A * | 3/1974 | Fayren | 114/265 |
| 3,978,807 | A | 9/1976 | Nitzki | |
| 4,026,227 | A * | 5/1977 | Cohn et al. | 114/264 |
| 5,791,819 | A * | 8/1998 | Christiansen | 405/224 |
| 6,209,474 | B1 * | 4/2001 | Foss et al. | 114/125 |
| 6,340,272 | B1 * | 1/2002 | Runge et al. | 405/203 |
| 6,503,023 | B2 * | 1/2003 | Huang et al. | 405/206 |
| 7,033,115 | B2 * | 4/2006 | Huang et al. | 405/206 |

FOREIGN PATENT DOCUMENTS

| | | |
|---|---|---|
| JP | 57-155188 | 9/1982 |
| JP | 61-81499 | 5/1986 |
| JP | 2001-180584 | 7/2001 |

* cited by examiner

*Primary Examiner* — Lars A Olson
(74) *Attorney, Agent, or Firm* — Foley & Lardner, LLP

(57) ABSTRACT

To provide the auxiliary float of a floating structure which can prolong the lifetime of the floating structure by reducing external force acting on the brace and can be used even at very deep water by increasing buoyancy, and to provide a remodeling method of the floating structure.

The auxiliary float (11) comprises two floats (12) coupled, respectively, to lower portions of two lower hulls (1) constituting a floating structure, two main coupling members (13) for coupling the floats (12) to each other, and four sub-coupling members (14) for coupling the main coupling member (13) and the float (12). The auxiliary float (11) is produced in advance and the floating structure is mounted on the auxiliary float (11), and then the lower hull (1) and the float (12) are connected, thus remodeling the floating structure.

5 Claims, 6 Drawing Sheets

Prior Art (B)

Prior Art

AUXILIARY FLOAT OF FLOATING STRUCTURE AND METHOD FOR REMODELING FLOATING STRUCTURE

TECHNICAL FIELD

The present invention relates to an auxiliary float for a floating structure used in the ocean that can prolong the lifetime of and increase the working water depth of the floating structure and a method for remodeling the floating structure. More specifically, the present invention is suitable for a floating structure of the semi-submersible type or semi-submerged type (referred to as semi-submersible type hereinafter).

BACKGROUND ART

In general, a marine structure is put in motion by external forces, such as waves, tides and winds, and such motion has to be reduced for reasons of performance and strength of equipment and attachments of the marine structure. To achieve this, the submerged portion of floating structures is elaborately designed in various ways. For example, according to a method, the waterplane area of the float is reduced, and the displacement of the submerged portion beneath the waterplane is increased, thereby reducing motion of the structure caused by waves having periods within a certain range. Floating structures based on this method is referred to as semi-submersible type, and the method is used for oilrigs, marine crane barges, pipe laying barges, production platforms, large offshore structures (such as offshore airports) and the like.

FIG. 6 are diagrams showing a semi-submersible oilrig. FIG. 6(A) is a schematic front view of the semi-submersible oilrig, and FIG. 6(B) is a side view of a floating structure of the semi-submersible oilrig. The floating structure of the semi-submersible oilrig has lower hulls 1 that provide a displacement under the water surface, an upper hull 2 that supports upper facilities, such as a machine room, an accommodation space and a rig, above the water surface, columns 3 that have a small cross section and couple the lower hulls 1 and the upper hull 2 to each other, and braces 4 that three-dimensionally couple these components to each other. In addition, FIG. 6(A) shows a derrick 6 that supports a drill pipe with a cutter for digging in the sea bottom 5 and a riser pipe 7 for circulating muddy water, which are main outer components of the semi-submersible oilrig.

A typical semi-submersible oilrig has two lower hulls 1 that constitute a float as shown in FIG. 6(A), has two to four columns 3 (four columns 3 in the drawing) on each lower hull as shown in FIG. 6(B), and has a plurality of braces 4 forming a truss structure below the upper hull 2 and between the opposing columns 3 as shown in FIG. 6(A). The lower hull 1 may have tapered ends to reduce the resistance when the semi-submersible oilrig is moved or towed. In general, semi-submersible oilrigs in their infancy have three to five columns interconnected by braces and mounted on an upper hull and separate floats, referred to as footings, connected to a lower portion of each column.

Such a semi-submersible oilrig moves floating with the lower hulls 1, and the lower hulls 1 and some of the columns 3 are filled with ballast water to make the oilrig sub-merged at the destination, thereby allowing the semi-submersible oilrig to conduct the digging operation at one fixed place in the ocean. In general, the draft is designed to prevent the bottom of the upper hull 2 from being washed by waves. Therefore, the braces 4 intersect the draft line, and external forces, such as a splitting force (a force to separate the lower hulls in the lateral direction), a pitch connection moment (a moment to make the lower hulls pitch out of phase with each other by 180 degrees) and a racking force (a force to move the lower hulls out of phase with each other by 180 degrees in the longitudinal direction), are exerted on the braces. Thus, the braces 4 and the joints are susceptible to damage from repeated applications of loads, such as waves. Such damage leads to collapse of the rig, and therefore, the lifetime of the semi-submersible oilrig depends on the durability of the braces 4.

As described above, the braces 4 are important to ensure the strength of the semi-submersible floating structure and therefore have to be maintained at regular intervals. Typically, the maintenance is performed on the ocean or in a dock by exposing the braces 4 above the water surface by discharging the ballast water. When the maintenance is performed in a dock, burdens or upper facilities on the upper hull 2 may be removed to reduce the total weight before the braces 4 are exposed above the water surface. There is a problem that the floating structure cannot be used during the maintenance. Thus, there is a demand that the durability of the floating structure is increased to minimize the frequency of maintenances of the braces 4 of the floating structure in operation.

In addition, although the semi-submersible floating structure has conventionally been used in areas of depths D between 300 and 500 m, recently, there is a growing demand that the semi-submersible floating structure is used in very deep water of 1500 m to 2000 m. To use the semi-submersible oilrig in very deep water, a longer drill pipe and a longer riser pipe 7 are needed, and therefore, the load on the upper hull 2 (the variable deck load) increases. For example, when the depth D is 300 to 500 m, the variable deck load is about 2000 to 2500 t. However, when the depth D is 1500 to 2000 m, the variable deck load is 4000 to 5000 t or more. As a result, the conventional floating structure cannot have sufficient buoyancy and therefore cannot be used without modification.

A method for increasing the buoyancy of a floating structure is to install an auxiliary float on a column or a lower hull. For example, in Japanese Patent Laid-Open No. 2001-180584 (patent literature 1), there is described an invention in which each column of a floating structure has an additional floating portion having a larger cross section at the level of the draft line. Furthermore, a method in which a box-shaped auxiliary float is installed on each lower hull and welded to a column and the lower hull and a method in which an auxiliary float is installed on the perimeter of each lower hull are also known.

Patent literature 1: Japanese Patent Laid-Open No. 2001-180584

DISCLOSURE OF THE INVENTION

Problems to be Solved by the Invention

However, the method for increasing the buoyancy described above requires separate welding of the additional floating portion or auxiliary float to the column and the lower hull and thus has a problem that the remodeling work is complicated and takes a long time. In addition, the external force exerted on the braces does not change compared with the conventional one, and therefore, the lifetime of the floating structure is not prolonged, so that regular maintenances are required as is conventionally done. In addition, there is a problem that the floating structure provided with the auxiliary floats on the perimeter of the lower hulls increases in width and thus cannot be accommodated in the dock.

Thus, an object of the present invention is to provide an auxiliary float for a floating structure that can reduce the external force exerted on a brace to prolong the lifetime of the floating structure and can increase the buoyancy to allow the floating structure to be used in very deep water, and a method for remodeling a floating structure.

Means for Solving the Problems

An auxiliary float according to the present invention is characterized in that the auxiliary float for a floating structure has a plurality of lower hulls forming a float, an upper hull constituting a deck, a plurality of columns that couples the lower hulls and the upper hull to each other, a brace coupled to an assembly of the lower hulls, the upper hull and the columns comprises floating bodies coupled to a lower portion of the lower hulls, and a plurality of coupling members that couple the floating bodies to each other.

The floating body may have a housing that is open on the side to be connected to the lower hull and a partition plate that divides the interior of the housing into a plurality of sections, and the housing may have a tapered surface at a longitudinal end thereof. The coupling members may include a main coupling member that couples the floating bodies to each other and a sub-coupling member that is coupled to the assembly of the main coupling member and the floating bodies.

A method for remodeling a floating structure according to the present invention is characterized in that, for a floating structure having a plurality of lower hulls forming a float, an upper hull constituting a deck, a plurality of columns that couples the lower hulls and the upper hull to each other and a brace coupled to an assembly of the lower hulls, the upper hull and the columns, an auxiliary float comprising floating bodies coupled to a lower portion of the lower hulls and a plurality of coupling members that couple the floating bodies to each other is previously manufactured, the floating structure is mounted on the auxiliary float, and the lower hulls and the floating bodies are connected to each other. Furthermore, a communicating hole that connects each interior of the lower hull and the floating body may be formed in the bottom surface of the lower hull, or an additional auxiliary float that complements the buoyancy of the auxiliary float may be provided on the lower hull.

Advantages of the Invention

Since the auxiliary float for a floating structure according to the present invention has the floating bodies coupled to the lower portion of the lower hulls and the plurality of coupling members that couple the floating bodies to each other, the auxiliary float according to the present invention can receive the external force that would otherwise be exerted on the braces (the splitting force, the pitch connection moment, the racking force and the like) to reduce the external force exerted on the braces and can improve the strength of the entire floating structure. As a result, the lifetime of the floating structure can be prolonged. In addition, the auxiliary float adds buoyancy to the floating structure to increase the load capacity thereof, thereby allowing the floating structure to be used in very deep water.

According to the method for remodeling a floating structure of the present invention, the auxiliary float can be previously manufactured, and the method requires only to connect the auxiliary float to the lower portion of the floating structure, more specifically, the lower portion of the lower hulls. Therefore, remodeling to increase the strength of the entire floating structure and increase the buoyancy thereof can be more easily accomplished in a shorter time.

BEST MODE FOR CARRYING OUT THE INVENTION

The best modes for carrying out the present invention will be described below with reference to FIGS. 1 to 5. The same components as those shown in FIG. 6, which shows a prior art, are denoted by the same reference numerals as those in FIG. 6, and redundant descriptions thereof will be omitted.

FIG. 1 is a perspective view of an auxiliary float 11 according to an embodiment of the present invention connected to a floating structure, viewed obliquely from below. Illustration of an upper hull of the floating structure is omitted. FIG. 2 is a top view of the auxiliary float 11 according to the present invention.

The auxiliary float 11 according to the present invention shown in FIGS. 1 and 2 comprises two floating bodies 12 coupled to a lower portion of two lower hulls 1 of the floating structure, respectively, two main coupling members 13 that couples the floating bodies 12 to each other, and four sub-coupling members 14 that couples the main coupling members 13 and the floating bodies 12 to each other.

The floating body 12 comprises a housing 12*a* that is open on the side to be connected to the lower hull 1 and a partition plate 12*b* that divides the interior of the housing 12*a* into a plurality of sections. In addition, the longitudinal opposite ends of the housing 12*a* have a tapered surface 12*c*. Thus, once the floating body 12 is connected to the lower portion of the lower hull 1, sectional spaces defined by the housing 12*a*, the partition plate 12*b* and the bottom of the lower hull 1 are formed to add buoyancy to the floating structure. Besides, the sectional spaces can be used as a ballast tank, a fuel tank or the like.

As shown in FIG. 1, the floating body 12 is preferably configured to form an integral unit with the lower hull 1 when the floating body 12 is connected to the lower hull 1. More specifically, the floating body 12 preferably has a width d substantially equal to the width of the lower hull 1 and a length l not more than the length of the lower hull 1 and is connected to the bottom of the lower hull 1 as seamlessly as possible by the tapered surfaces 12*c*. These conditions are intended for workability of connecting the auxiliary float 11 and resistance against movement or towing of the floating structure. The height h is determined by requirements including the buoyancy required for remodeling of the floating structure and the strength of the coupling members 13 and 14. However, considering the workability of connecting the auxiliary float 11, the height is preferably enough for a person to stand upright. This is because workers perform welding or other works in the floating body 12 when the auxiliary float 11 is connected to the floating structure.

The main coupling members 13 and the sub-coupling members 14 are coupling members that couple the two floating bodies 12 to each other. The coupling members 13 and 14 are made of a steel plate, a steel pipe or the like and have a higher mechanical strength than braces 4. More specifically, the coupling members 13 and 14 may be made of a steel having a higher strength than the steel forming the braces 4 or have a larger diameter or be thicker than the braces 4.

The main coupling members 13 are disposed close to the opposite ends of the floating bodies 12 and welded to the floating bodies 12 at substantially right angles. Each sub-coupling member 14 is disposed to obliquely extend from a vicinity of the center of one main coupling member 13 toward the center of one floating body 12 and welded to the main coupling member 13 and the floating body 12. Therefore, as shown in FIGS. 1 and 2, the auxiliary float 11 has a diamond-shaped opening around the center thereof. The coupling members 13 and 14 connected to each other in this way allow a cutter or a riser pipe of an oilrig to pass through the center thereof while increasing the strength of the auxiliary float 11.

FIG. 3 is a top view of an auxiliary float 11 according to another embodiment of the present invention. In this embodiment, four or two pairs of main coupling members 31*a* and 31*b* are connected to floating bodies 12, and the main coupling members 31*a* and 31*b* of each pair are connected to each other by sub-coupling members 32. All the main coupling members 31*a*, 31*b* may have the same shape, or the inner main coupling members 31*b* may be thinner than the outer main coupling members 31*a*. As shown in FIG. 3, the main coupling members 31*a*, 31*b* and the sub-coupling members 32 disposed in this way also allow a cutter or a riser pipe of an oilrig to pass through the center thereof while increasing the strength of the auxiliary float 11.

Once connected to the bottom of the floating structure as shown in FIG. 1, the auxiliary float 11 according to the present invention shown in FIG. 2 or 3 receives the external force that would otherwise be exerted on the braces 4 (the splitting force, the pitch connection moment, the racking force and the like) to reduce the external force exerted on the braces 4 and improves the strength of the entire floating structure, thereby prolonging the lifetime of the floating structure. In addition, the auxiliary float 11 adds to the buoyancy of the floating structure to increase the load capacity thereof, thereby allowing the floating structure to be used in very deep water.

Next, with reference to FIG. 4, a method for remodeling a floating structure according to the present invention will be described.

(1) As shown in FIG. 4(A), the auxiliary float 11 is previously manufactured in a factory. More specifically, the floating bodies 12 are manufactured, and then the main coupling members 13 and the sub-coupling members 14 are welded to the floating bodies 12. Information about the dimensions of a floating structure 41 to be remodeled and the load capacity to be added is previously collected, and the dimensions and positions of the floating bodies 12 and the coupling members 13 and 14 are determined based on the information.

(2) As shown in FIG. 4(B), the auxiliary float 11 is placed in a dock 42 that accommodates the floating structure 41. The floating structure 41 is composed of lower hulls, an upper hull, columns and braces. Reference numeral 43 denotes a batten.

(3) As shown in FIG. 4(C), ballast water is poured into the dock 42 to sink the dock 42 to a depth equal to the draft of the floating structure 41.

(4) As shown in FIG. 4(D), the floating structure 41 is towed into the dock 42. The position of the floating structure 41 is adjusted so that the floating structure 41 rests on the auxiliary float 11.

(5) As shown in FIG. 4(E), the ballast water is discharged from the dock 42 until the floating structure 41 on the auxiliary float 11 is exposed above the water surface.

(6) In the state shown in FIG. 4(E), the auxiliary float 11 is connected to the floating structure 41. First, the water remaining in the lower hulls of the floating structure 41 and the auxiliary float 11 is discharged, and then, communicating holes that open into the sectional spaces in the auxiliary float 11 are appropriately formed in the bottom surface of the lower hulls of the floating structure 41. The holes are formed by workers in the auxiliary float 11.

(7) Then, the partition plates of the floating bodies of the auxiliary float 11 are welded to the bottom surface of the lower hulls. The welding is also conducted by workers in the auxiliary float 11. Then, the outer wall of the lower hulls and the outer wall of the floating bodies of the auxiliary float 11 are welded to each other.

(8) When all the operations (such as relocation of necessary loads and installation of upper facilities) are completed, ballast water is poured into the dock 42 to make the remodeled floating structure 41 float as shown in FIG. 4(F).

According to the method for remodeling the floating structure 41 described above, the auxiliary float 11 can be separately manufactured in a factory or the like, so that the floating structure 41 can be kept operating even during the manufacture of the auxiliary float 11, and therefore, the utilization rate of the floating structure 41 can be increased. Furthermore, the remodeling is easily achieved only by placing the floating structure 41 on the auxiliary float 11 and connecting the lower hulls and the floating bodies to each other, so that the time required for remodeling of the floating structure 41 can be reduced. Furthermore, because of the configuration of the auxiliary float 11 according to the present invention, the strength and buoyancy of the entire floating structure can be increased by simple remodeling. Furthermore, the communicating holes formed in the bottom of the lower hulls connect the ballast tanks in the lower hulls and the sectional spaces in the floating bodies to each other, so that the auxiliary float 11 can also be used as a ballast tank.

FIG. 5 is a perspective view of an auxiliary float 11 according to another embodiment of the present invention connected to a floating structure, viewed from the same angle as in FIG. 1. According to this embodiment, when the auxiliary float 11 does not provide sufficient buoyancy, additional auxiliary floats 51 are installed on lower hulls 1. The additional auxiliary floats 51 are made of steel plates and have the shape of a hollow column. The additional auxiliary floats 51 are mounted close to the opposite ends of the lower hulls 1, and each additional auxiliary float 51 is welded to the lower hull 1 and a column 3. The size of the additional auxiliary floats 51 is calculated and determined when the auxiliary float 11 is designed. For example, in order for the floating structure to have a desired load capacity, the height h of the auxiliary float 11 has to be increased, and the height h of the auxiliary float 11 and the size of the additional auxiliary floats have to be adjusted so that the auxiliary float 11 and the additional auxiliary floats 51 provide required buoyancy. The additional auxiliary floats 51 are mounted on the lower hulls and welded to the floating structure in the state shown in FIG. 4(E).

The present invention is not limited to the embodiments described above and, of course, various modifications are possible without departing from the spirit of the present invention. For example, the width d of the floating bodies 12 may be larger or smaller than the width of the lower hulls 1, the length l of the floating bodies 12 may be larger than the length of the lower hulls, the coupling members 13, 14 may be arranged in different ways depending on the usage of the floating structure, and the auxiliary float 11 may be applied to a floating structure with footings.

BRIEF DESCRIPTION OF THE DRAWINGS

FIG. 6 is a set of diagrams showing a semi-submersible oilrig, in which FIG. 6(A) is a schematic front view of the semi-submersible oilrig, and FIG. 6(B) is a side view of a floating structure of the semi-submersible oilrig.

Figure 1:
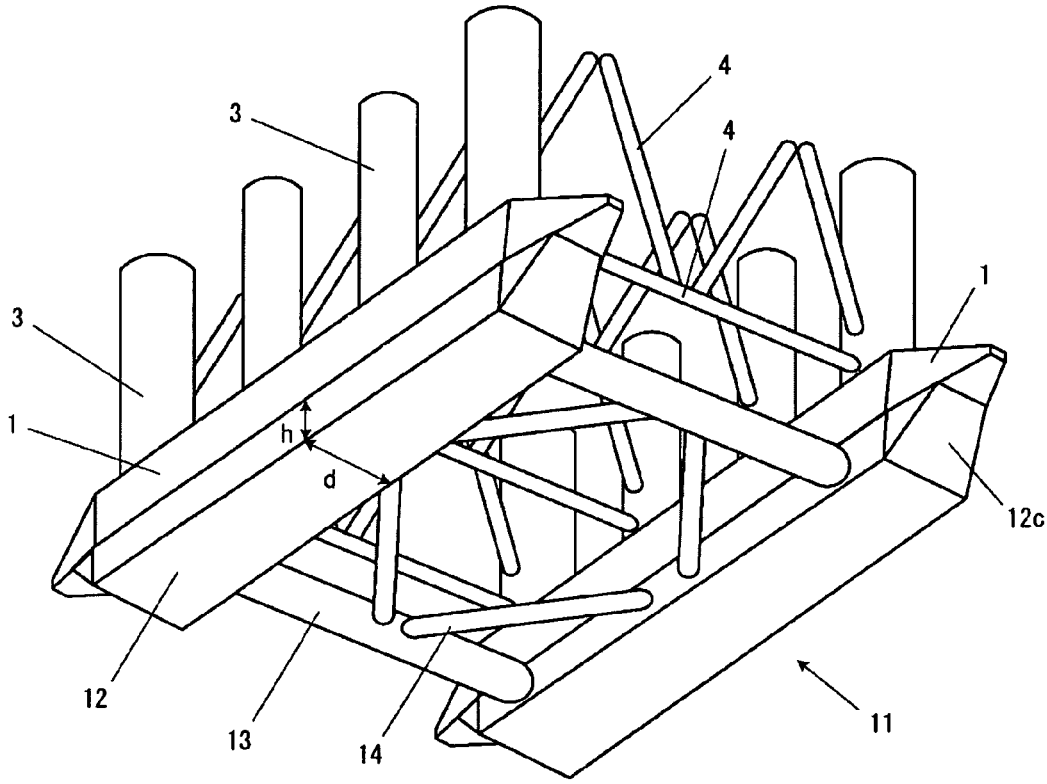
FIG. 1 is a perspective view of an auxiliary float according to an embodiment of the present invention connected to a floating structure.
Figure 2:
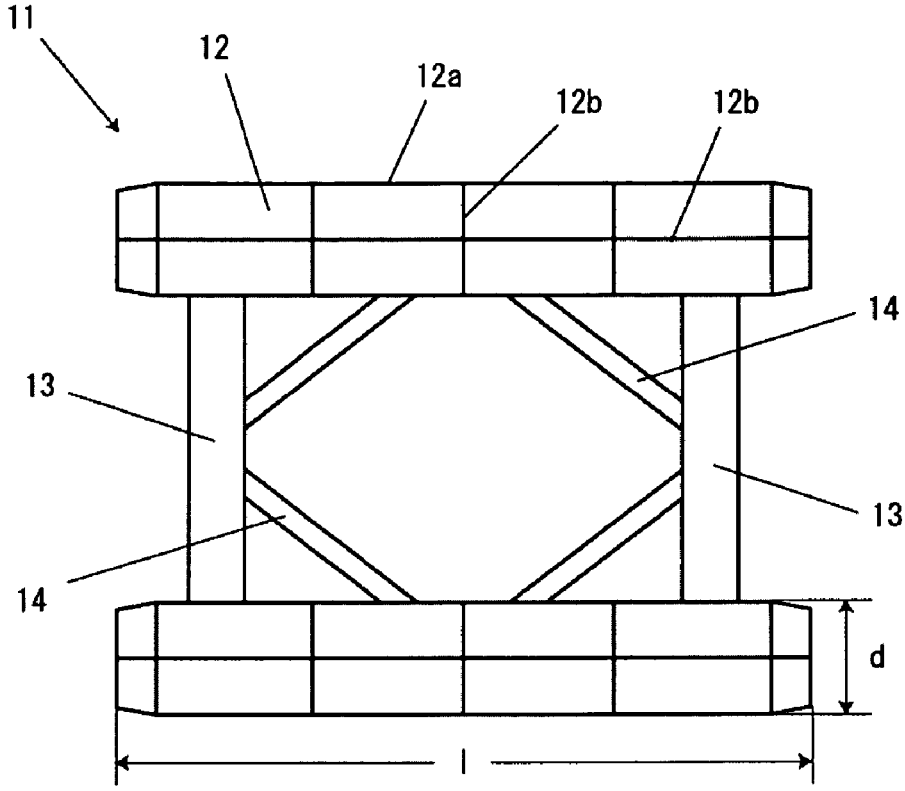
FIG. 2 is a top view of the auxiliary float according to the present invention.
Figure 3:
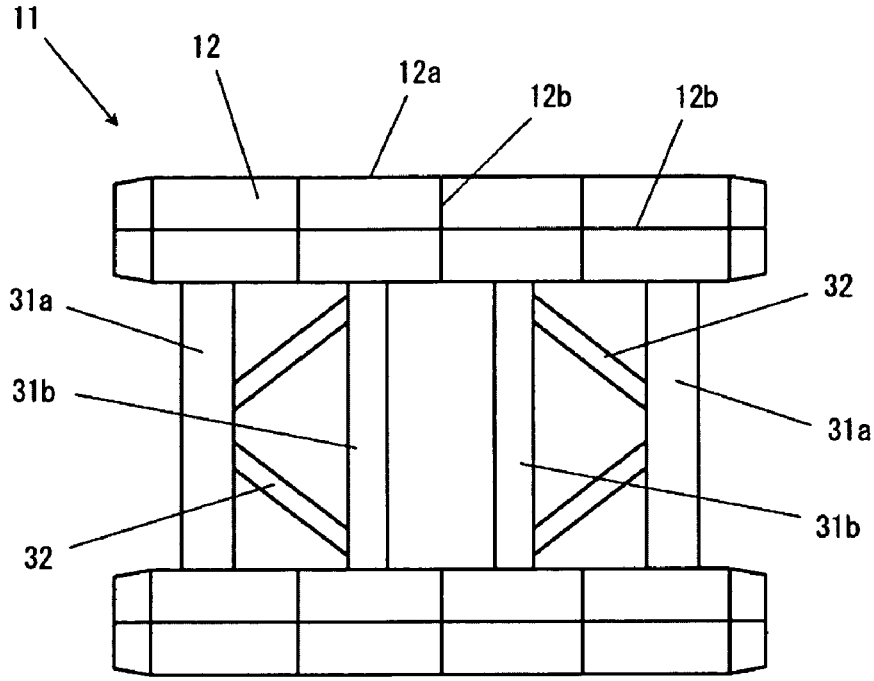
FIG. 3 is a top view of an auxiliary float according to another embodiment of the present invention.
Figure 4:
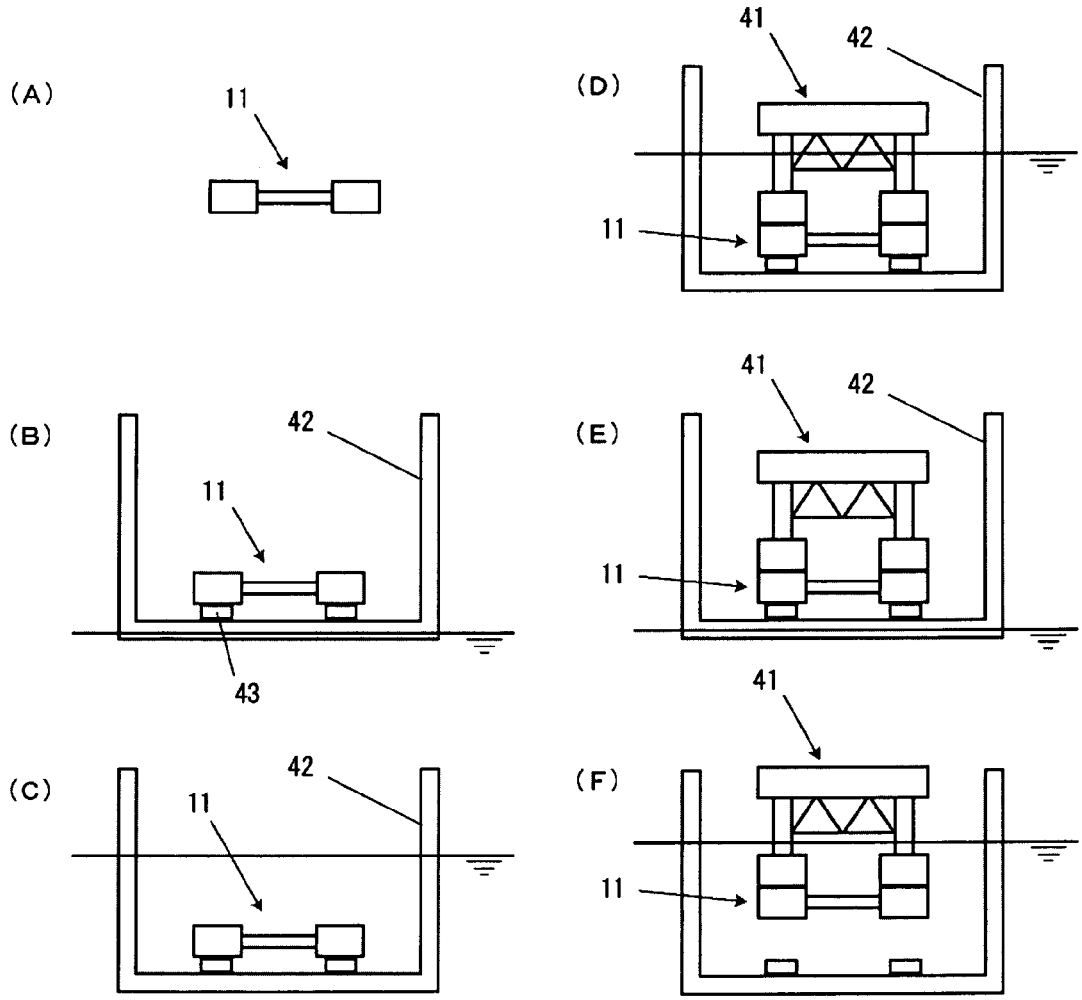
FIG. 4 is a set of diagrams for illustrating a method for remodeling a floating structure according to the present invention.
Figure 5:
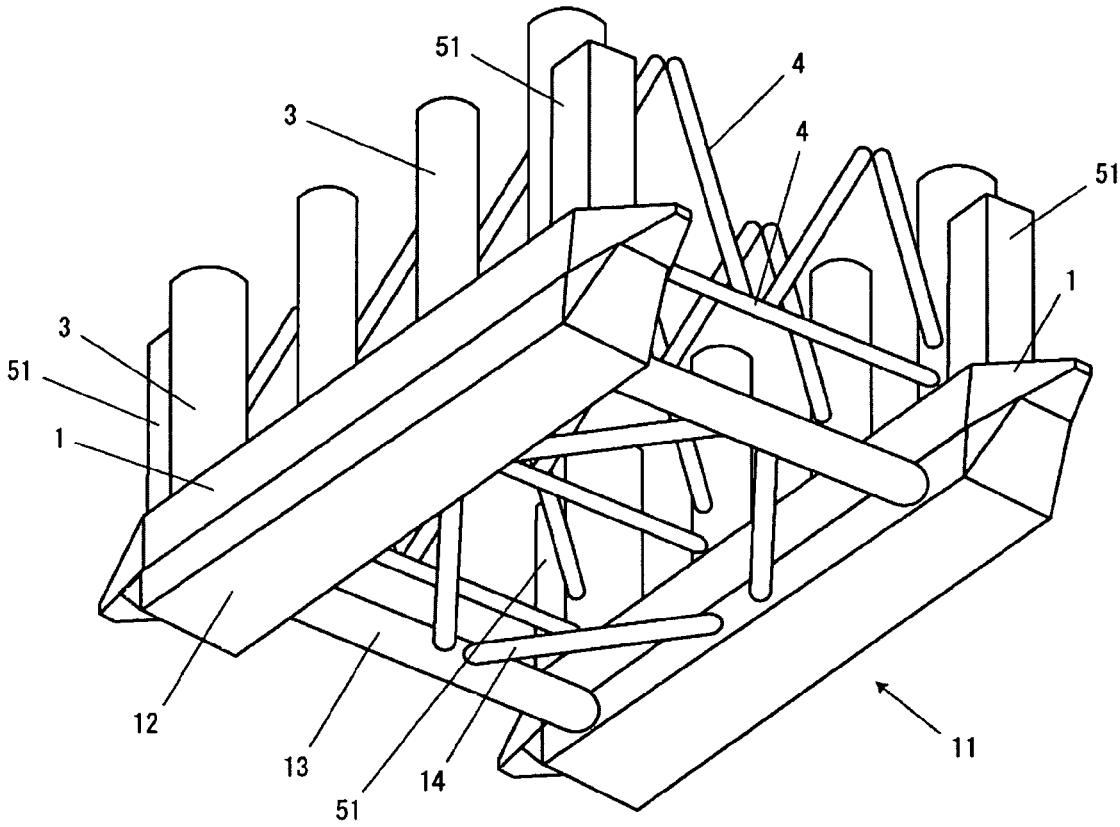
FIG. 5 is a perspective view of an auxiliary float according to another embodiment of the present invention connected to a floating structure.
Figure 6:
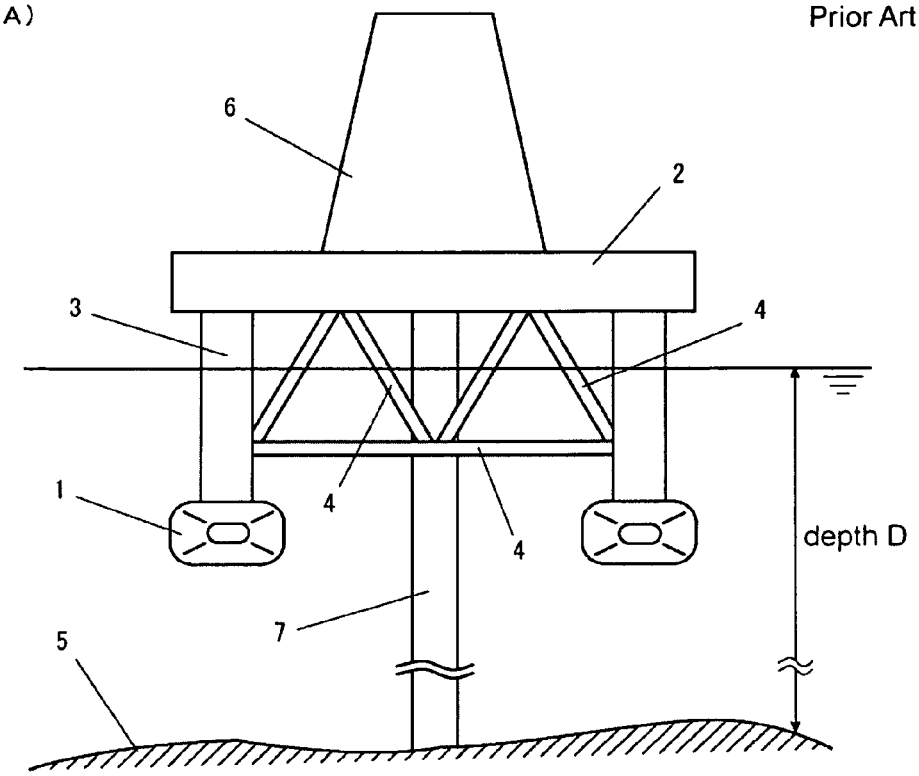
Figure 6:
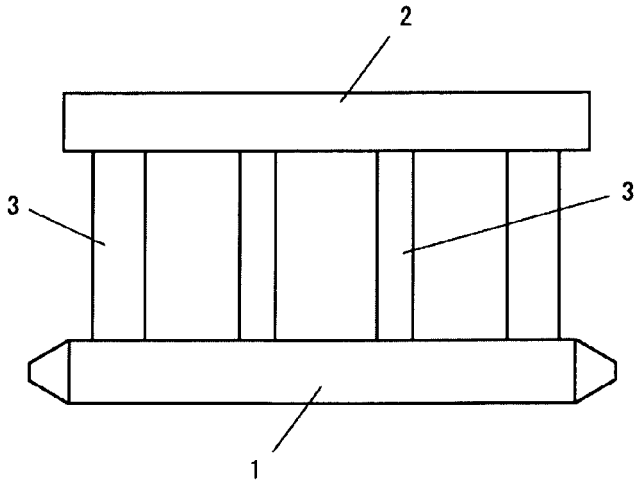

The invention claimed is:

1. An auxiliary float of a floating structure, wherein the floating structure includes a plurality of lower hulls forming a float, an upper hull constituting a deck, a plurality of columns that couples said lower hulls and said upper hull to each other, and a brace coupled to an assembly of said lower hulls, said upper hull and said columns, the auxiliary float comprising:

floating bodies coupled to a lower portion of said lower hulls; and a plurality of coupling members that couple the floating bodies to each other, wherein said floating body has a housing that is open on the side to be connected to said lower hull and a partition plate that divides the interior of the housing into a plurality of sections.

2. The auxiliary float of a floating structure according to claim 1, wherein said housing has a tapered surface at a longitudinal end thereof.

3. An auxiliary float of a floating structure, wherein the floating structure includes a plurality of lower hulls forming a float, an upper hull constituting a deck, a plurality of columns that couples said lower hulls and said upper hull to each other, and a brace coupled to an assembly of said lower hulls, said upper hull and said columns, the auxiliary float comprising:

floating bodies, configured to give buoyancy to the floating structure and to reduce a draft of the floating structure, coupled to a lower portion of said lower hulls; and a plurality of coupling members that couple the floating bodies to each other, wherein said coupling members include a main coupling member that couples said floating bodies to each other and a sub-coupling member that is directly coupled to the main coupling member and said floating bodies.

4. A method for remodeling a floating structure, wherein, for a floating structure having a plurality of lower hulls forming a float, an upper hull constituting a deck, a plurality of columns that couples said lower hulls and said upper hull to each other, and a brace coupled to an assembly of said lower hulls, said upper hull and said columns, the method comprising the steps of:

providing an auxiliary float including floating bodies to be coupled to a lower portion of said lower hulls and a plurality of coupling members that couple the floating bodies to each other, mounting said floating structure on the auxiliary float, connecting said lower portion of said lower hulls and said floating bodies to each other to thereby reinforce and provide increased strength for the floating structure, and forming a communicating hole that connects the interior of said lower hull and the inner space of said floating body in the bottom surface of said lower hull.

5. The method for remodeling a floating structure according to claim 4, further comprising the step of providing an additional auxiliary float on said lower hull; wherein the additional auxiliary float complements the buoyancy of the auxiliary float.

* * * * *